United States Patent [19]

von Matuschka et al.

[11] Patent Number: 4,637,837

[45] Date of Patent: Jan. 20, 1987

[54] PROCESS FOR BORIDING METALS AND METAL ALLOYS BY MEANS OF SOLID BORIDING AGENTS

[75] Inventors: Alfred G. von Matuschka, Sauerlach; Norbert Trausner, Betzigau, both of Fed. Rep. of Germany

[73] Assignee: Elektroschmelzwerk Kempten GmbH, Munich, Fed. Rep. of Germany

[21] Appl. No.: 747,019

[22] Filed: Jun. 20, 1985

[30] Foreign Application Priority Data

Aug. 23, 1984 [DE] Fed. Rep. of Germany ..... 3431044

[51] Int. Cl.[4] ..... C23C 9/04

[52] U.S. Cl. ..... 148/6; 148/6.35; 427/255.4

[58] Field of Search ..... 427/255.4; 148/6.35, 148/6

[56] References Cited

U.S. PATENT DOCUMENTS

| | | | |
|---|---|---|---|
| 3,197,328 | 7/1965 | Jung et al. | 427/255.4 |
| 3,252,823 | 5/1966 | Jacobson | 427/213 |
| 3,744,979 | 7/1973 | Kalish | 148/6 B |
| 3,809,583 | 5/1974 | Krzyminski | 148/6 B |

*Primary Examiner*—Sam Silverberg

*Attorney, Agent, or Firm*—Burgess, Ryan & Wayne

[57] ABSTRACT

A process is provided for boriding metals and metal alloys in a fluidized bed at a temperature of from about 580° to about 1300° C. As a boriding agent, there was used a granular material comprising essentially spherical particles having a particle size of from about 0.025 to about 5.00 mm, which granular material was manufactured by spray drying a preferably aqueous suspension or dispersion based on materials that yield boron, and which can contain fillers, extenders and binders.

8 Claims, 1 Drawing Figure

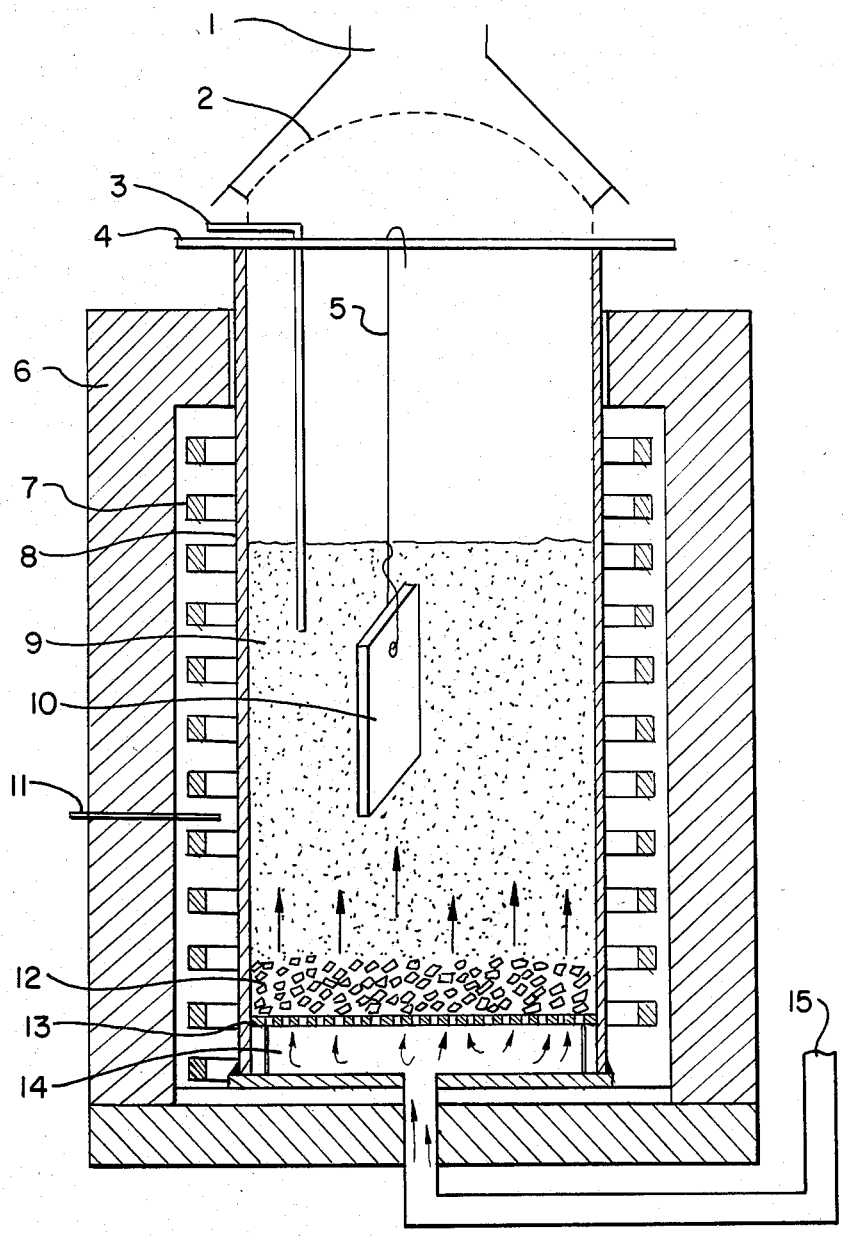
1
2
3
4
5
6
7
8
9
10
11
12
13
14
15

PROCESS FOR BORIDING METALS AND METAL ALLOYS BY MEANS OF SOLID BORIDING AGENTS

FIELD OF THE INVENTION

This invention relates in general to a process for boriding metals and metal alloys. In one aspect, this invention is directed to a process for boriding metal surfaces wherein the boriding agent is in granular form. In a further aspect, the present invention relates to a method for boriding metals and metal alloys wherein the boriding is effected in a fluidized bed employing a solid boriding agent.

BACKGROUD OF THE INVENTION

It is known that very hard surfaces can be produced on metals and metal alloys by reaction of such surfaces with boron-containing materials. This surface hardening can be effected on metals by means of gaseous substances, such as diborane or borohalides, liquid media, such as borax melts, or alternatively by means of solid boriding agents. On toxicological, economic and technological grounds, it has been possible to obtain successful results only with solid boriding agents, such as powders and pastes.

Processes for boriding metals and metal alloys by means of powders and pastes are described in detail in DE-PS No. 17 96 215 (H. Kunst, Elektroschmelzwerk Kempten GmbH; issued on July 26, 1973), DE-PS No. 21 46 472 (W. Fichtl et al., Elektroschmelzwerk Kempten GmbH; issued on Sept. 7, 1978), DE-PS No. 22 08 734 (G. Wiebke et al., Elektroschmelzwerk Kempten GmbH, issued on July 31, 1980) and DE-AS No. 23 61 017 (E. Preuschen, Vac-Hyd Processing GmbH, published on Aug. 30, 1979).

In the case of powder boriding, the parts to be borided are placed in containers and are closely covered with a powder that yields boron. The containers are then placed in a pre-heated furnace and kept at temperatures of approximately 800° to 1100° C., then cooled and subsequently emptied.

In the case of paste boriding (DE-AS No. 23 61 017), a layer of boriding agent of as uniform a thickness as possible is applied to the workpiece, then dried and treated at temperatures of approximately 800° to 1100° C. for several hours.

The boriding agent usually contains, as the substance that yields boron, crystalline or amorphous boron, boron carbide, ferroboron, borax or mixtures of at least two of these constituents; as fillers, for example, carbon black, silicon carbide, silica, aluminium oxide or magnesium oxide, and, as activators, especially complex fluorides, such as potassium tetrafluoroborate. The heat treatment is carried out in box furnaces, pot furnaces, continuous belt furnaces, continuous chain furnaces or vacuum furnaces.

In the case of powder boriding processes, the parts to be treated must be loaded and unloaded, each of which operations creates troublesome dust. The heating and cooling periods are relatively long because of the poor transmission of heat through the boriding powder. The boriding medium, which is relatively expensive, is generally used in excess. In paste boriding, the paste must be applied in a layer of very uniform thickness. Drying the paste is also time-consuming.

Accordingly, one or more of the following objects will be achieved by the practice of the present invention. It is an object of this invention to provide a boriding process that is considerably less time consuming and labor intensive than processes heretofore known. A further object of the present invention is to provide a boride layer on the surfaces of metals or metal alloys. Another object of this invention is to provide on the surface of iron and iron containing alloys, by boriding in a fluidized bed, boride-containing layers of which the iron boride content consists essentially of $Fe_2B$. A further object is to provide a process for boriding metals and metal alloys in a fluidized bed using as solid boriding agents, a granular material comprising essentially spherical particles having a particle size of from about 0.025 to 5.0 mm. These and other objects will readily become apparent to those skilled in the art in the light of the teachings herein set forth.

SUMMARY OF THE INVENTION

A boriding agent in granular form is known for DE-OS No. 21 27 093 (H. Krzyminski, Deutsche Gold- und Silver- Scheideanstalt, laid open on Dec. 14, 1972). As a result of its cylindrical particles, however, it is unsuitable for a fluidized bed process. The known boriding powders cannot be used in this process because of their particle size and particle distribution. In the process according to the present invention, it is possible in principle to use any solid boriding agent formulations of which the particles can be kept in a fluidized state at the reaction temperature in a flowing gaseous medium. Almost any spherical particles having a particle size of from about 0.025 to about 5.0 mm are preferred, particle sizes of from about 0.05 to about 2.0 mm being especially preferred.

BRIEF DESCRIPTION OF THE DRAWING

The FIGURE is a representation of a fluid bed apparatus suitable for carrying out the process of the invention.

DETAILED DESCRIPTION OF THE INVENTION AND DRAWING

The granular material used in the process according to the present invention can be formulated, for example, from any powder that has previously been used successfully in boriding metals. As substances that yield boron, the powders may contain amorphous or crystalline boron, boron carbide, borax or metal borides, or mixtures of at least two of these substances. Boron carbide is especially preferred. As fillers that are simultaneously extenders there may be used carbon black, silicon carbide, oxides of aluminium, magnesium and silicon, silicates, non-boridable metals, and mixtures thereof or similar substances. As activators, the boriding agents may contain, either individually or in admixture, any substances that have previously been used as activators in boriding metals and their alloys. Complex fluorides, especially potassium tetrafluoroborate, are preferred.

For the purpose of granulating or pelletising the boriding agent, it is possible in principle to use any processes in which it is possible to produce particles of the desired shape and particle size, such as, for example build-up granulation on the granulation plate and fluidized bed granulation. During the granulation or pelletization, one or more inorganic or organic binders and auxiliaries may be added to the mixture.

It is preferable to use a method not normally used for this purpose: spray drying. This process is generally used for the manufacture of highly dispersed and redispersable particles, that is to say particles of low mechanical stability. As a result of spray drying the boriding mixture, which process is also a subject of the invention, there are formed, however, particles that are mechanically stable and, as a result of their essentially spherical shape, their particle size, their narrow particle size distribution and their dimensional stability under the reaction conditions, are especially suitable for use in a fluidized bed process. Before spray drying, there are added to the powder to be granulated, binders, a dispersion agent that is inert towards the powder constituents, and emulsifiers. Preferred binders are saccharides, disaccharides, polysaccharides and mixtures of at least two of these substances. On environmental grounds and for reasons of cost, water is preferred as the dispersion agent that is inert towards the powder constituents. Based on the weight of boriding agent to be granulated and the stabilizer, there are added from about 10 to about 100% by weight, preferably from about 20 to about 70% by weight, of dispersion agent. The use of more dispersion agent is possible but requires a higher energy consumption or a lower throughput during spray drying. It is possible to add emulsifiers to the mixture to be granulated. Although not absolutely necessary for the process according to the invention, it is also possible to add auxiliaries, such as protective colloids, anti-foaming agents and atomizing auxiliaries. The binder is preferably used in amounts of from 2 to 30% by weight, based on the total weight of the dry granular material, that is to say the substance that yields boron, fillers and activators, emulsifiers, auxiliaries and binders; amounts between about 5 and about 20% by weight are especially preferred. The amount of the substance that yields boron may constitute between about 2 and about 90% by weight, based on the dry granular material, depending upon the affinities of the surfaces to be borided. The activator is used in amounts of from about 1 to about 15% by weight, preferably from about 3 to about 8% by weight. No advantage is to be gained by using larger amounts of activator.

In the fluidized bed boriding process according to the present invention, the granular boriding material can be used as the only fluidized material or it can be used in admixture with a granular material that is inert towards the substance that yields boron. Such an inert granular material can consist, for example, of the above-mentioned fillers.

The fluidized bed boriding process according to the invention is carried out in a retort consisting of a gas-tight material that is stable at the reaction temperature, preferably in a ceramic retort or in a retort the interior of which is coated with ceramic material.

As fluidizing gases, there are preferably used inert gases and gaseous mixtures or reducing gases and gaseous mixtures. Examples of inert gases and gaseous mixtures are nitrogen, argon and mixtures thereof. Examples of reducing gases and gaseous mixtures are hydrogen, dissociated ammonia, forming gas (5–30% hydrogen, 70–95% nitrogen), hydrocarbons, mixtures of at least two of these reducing gases, and mixtures of at least one reducing gas with at least one inert gas.

The boriding process according to the invention is carried out at temperatures of from about 580° to about 1300° C., preferably from about 580° to about 1100° C. and especially preferably from about 800° to about 1100° C. The fluidized bed boriding process makes it possible for articles to be borided individually or in batches in a continuous or semi-continuous operation and in conjunction with subsequent treatments. In general, it is advisable to preheat the workpieces to be borided before the actual boriding step. During the process, granular boriding material that has largely been consumed can be removed from the fluidized bed, for example by suction or a pneumatic conveyor; fresh boriding agent can be added to the reactor at any time. Fully-continuous operation can be achieved, for example, by controlling the stream of boriding agent in the moving bed. The boriding process can be followed by other process steps that have proved successful in metal treatment. For example, the boriding of steels can be followed by diffusion annealing, austenitising, quenching and/or tempering.

In comparison with powder boriding processes, in which generally a large excess of boriding agent is used, the process according to the invention enables the relatively expensive boriding medium to be utilized in a more economical manner. Fluidized bed boriding produces a complete boride layer of uniform thickness. Using the process according to the invention, it is possible to boride any metals and metal alloys that could be borided by processes known hitherto. Examples of these metals and metal alloys are iron, cobalt, nickel, titanium, steels, hard metal, and alloys containing iron, cobalt, nickel and/or titanium. On the surface of iron-containing alloys and iron, there is obtained a single-phase iron boride layer, that is to say the iron boride formed consists substantially of $Fe_2B$. Most of the other processes produce two-phase layers of which one phase contains $Fe_2B$ and the other contains FeB. Stresses can occur in such two-phase iron boride-containing layers which ultimately results in cracks.

The present invention will be more readily understood by reference to the single drawing of a retort in which the process of the present invention is conducted and wherein the retort is comprised of suction nozzle 1, fine-mesh screen 2, thermocouple 3, support rods 4 and suspension means 5, for workpiece 10, cladding 6, heating elements 7, container wall 8, fluidized bed 9, workpiece to be borided 10, thermocouple 11, coarse-grained $SiC/Al_2O_3$ for better distribution of the fluidizing gas 12, perforated plate 13, gas equalization and mixing chamber 14, and gas supply 15.

In the following examples the granular boriding material employed is prepared from a suspension of:

- 20,950 g of silicon carbide
- 810 g of boron carbide (commercially available under the trade name "Tetrabor", Elektroschmelzwerk Kempten GmbH, Munich, Federal Republic of Germany)
- 1,160 g of potassium tetrafluoroborate
- 2,000 g of a 50% by weight aqueous saccharose solution
- 13,000 g of water, and
- 0.2 g of emulsifier (commercially available under the trade name "Targo 1128 X", Benckiser und Knapsack, Ladenburg, Federal Republic of Germany)

the above suspension is stirred at 30° C. and introduced slowly from above into the spraying tower which has been preheated to approximately 350° C. A dry granular material is formed at approximately 60° C. The granular material comprises almost spherical particles having a particle size of between 0.080 and 0.220 mm.

For boriding, the workpieces are heated to the desired reaction temperature. The reaction is carried out in an externally heated fluidized bed the internal wall of which consists of ceramic material as shown in the drawing.

The following examples are illustrative:

EXAMPLE 1

A plate of steel Ck 45 was suspended in a boriding agent prepared as previously indicated in a fluidized bed at 920° C. and kept there at this temperature for 2 hours. After this time, the sample cooled in the shaft rising above the fluidized bed furnace in the gas atmosphere. Forming gas (95% nitrogen, 5% hydrogen) was used as the fluidizing gas. The surface of the sample was free of boriding agent. Under these boriding conditions, a single-phase boride layer approximately 100 μm in thickness was formed.

EXAMPLE 2

Latches and trip cams of steel St 37 K were borided at 920° C. in a fluidized bed in accordance with Example 1 but in this case for 3 hours. Forming gas (90% nitrogen, 10% hydrogen) was used as the fluidizing gas.

A micrograph revealed a single-phase boride layer approximately 140 μm in thickness.

EXAMPLE 3

Gear wheels of 42 CrMo 4-steel were borided using the boriding agent prepared as indicated above for 45 minutes at 860° C. using forming gas (90% nitrogen, 10% hydrogen) as fluidizing gas.

The gear wheels were removed from the fluidized bed and then quenched in an oil bath. The gear wheels had a single-phase boride layer 30 μm in thickness. The duration of the treatment from preparation to the end of hardening was approximately 2 hours. According to the processes known hitherto, a treatment cycle of at least two days' duration was necessary to achieve an equivalent result.

What is claimed is:

1. A process for boriding metals and metal alloys using a solid boriding agent comprised of materials that yield boron, said process comprising conducting said boriding in a fluidized bed at a temperature of from about 580° to about 1300° C. using as the solid boriding agent material in granular form and comprised essentially of spherical particles having a particle size of from about 0.025 to about 5.0 mm.

2. The process according to claim 1 wherein said spherical particles have a particle size of from about 0.05 to about 2.0 mm.

3. The process according to claim 1 wherein said boriding agent contains materials that yield boron, and activators, fillers, extenders and binders.

4. The process according to claim 1 wherein said granular material contains boron carbide.

5. The process according to claim 3 wherein said activator is potassium tetrafluoroborate.

6. The process according to claim 3 wherein said filler is silicon carbide.

7. The process according to claim 3 wherein said binder is a saccharide.

8. The process according to claim 1 wherein said granular material has been prepared by spray drying an aqueous suspension or dispersion of said material using mono- di- or polysaccharides as binders.

* * * * *